US012622502B2

(12) United States Patent
Park et al.

(10) Patent No.: US 12,622,502 B2
(45) Date of Patent: May 12, 2026

(54) APPLICATOR TO CREATE MULTIPLE THIN AND CLOSE LINES

(71) Applicant: L'Oreal, Paris (FR)

(72) Inventors: Kyoo Jin Park, Leonia, NJ (US); William Bickford, Scotch Plains, NJ (US)

(73) Assignee: L'Oreal, Paris (FR)

( * ) Notice: Subject to any disclaimer, the term of this patent is extended or adjusted under 35 U.S.C. 154(b) by 431 days.

(21) Appl. No.: 17/829,140

(22) Filed: May 31, 2022

(65) Prior Publication Data

US 2023/0380572 A1 Nov. 30, 2023

(51) Int. Cl.
*A45D 34/04* (2006.01)

(52) U.S. Cl.
CPC .... *A45D 34/042* (2013.01); *A45D 2200/1072* (2013.01)

(58) Field of Classification Search
CPC .... A45D 34/04; A45D 34/041; A45D 34/042; A45D 40/28; A45D 40/20; A45D 2200/1072; A45D 2200/1018; B34K 27/02; B34K 27/04; B34K 27/08; A46B 9/02; A46B 9/021; A46B 9/023; A46B 9/025; A46B 2200/1046
USPC ..... D28/7; D19/115; 401/35; 132/320
See application file for complete search history.

(56) References Cited

U.S. PATENT DOCUMENTS 339,817 A * 4/1886 Smitten ..... B43K 17/02 15/435
365,011 A * 6/1887 Ludington ..... B43K 3/00 15/435
371,133 A * 10/1887 Fisher ..... B43K 27/02 401/256
448,450 A * 3/1891 Mayer ..... B43K 27/08 401/256
519,953 A * 5/1894 Henry ..... B43K 1/00 401/35

(Continued)

FOREIGN PATENT DOCUMENTS

FR 2913187 A1 * 9/2008 ..... A46B 3/12
JP 3196621 U 3/2015

(Continued)

OTHER PUBLICATIONS

Nespoli Luigi, "FR_2913187_A1_translated" (Year: 2008).*
Search Report and Written Opinion, mailed Mar. 6, 2023, in corresponding French Patent Application No. 22 08313, 6 pages.

*Primary Examiner* — Thomas C Barrett
*Assistant Examiner* — Holly T. To
(74) *Attorney, Agent, or Firm* — Christensen O'Connor Johnson Kindness PLLC

(57) ABSTRACT

An applicator that draws fine lines and dots includes a body sleeve having a shape of an elongated tube, a first drawing tool having a first section within the body sleeve and a first tip extending out from the body sleeve, wherein the first drawing tool reduces in size at a distal end of the first drawing tool, a second drawing tool having a second section within the body sleeve and a second tip extending out from the body sleeve, wherein the second drawing tool reduces in size at a distal end of the second drawing tool, and the first drawing tool, the second drawing tool, or both first and second drawing tools have a bend to bring the first and second tips closer together.

13 Claims, 5 Drawing Sheets

(56) References Cited

U.S. PATENT DOCUMENTS 599,372 A * 2/1898 Tallmadge ..... B65D 47/42 401/196
1,244,192 A * 10/1917 Gosman ..... B43K 27/02 401/128
1,300,379 A * 4/1919 Greenfield ..... B43K 27/08 401/35
1,727,110 A * 9/1929 Lecroy ..... B43K 8/003 401/35
2,416,896 A * 3/1947 Laszlo ..... B43K 7/02 401/217
2,449,939 A * 9/1948 Heyberger ..... B43K 27/12 401/35
2,453,201 A * 11/1948 Cushman ..... B43K 8/02 401/199
2,541,949 A * 2/1951 Thacker ..... A45D 34/042 222/391
2,585,016 A * 2/1952 Kollsman ..... B43K 27/12 401/35
3,079,895 A * 3/1963 Gordon ..... B43K 27/12 401/35
3,090,070 A * 5/1963 Simons ..... A46B 11/0041 222/215
3,107,654 A * 10/1963 Fehrenbach ..... B43K 27/12 D19/119
3,157,950 A * 11/1964 Duncan ..... B43L 13/12 33/578
3,164,906 A * 1/1965 Andaloro ..... B43K 27/08 401/35
3,363,968 A * 1/1968 Williams ..... B65D 83/44 401/281
3,399,020 A * 8/1968 Margolis ..... A45D 34/042 401/135
3,678,947 A * 7/1972 Ehrlich ..... A45D 34/042 401/199
4,017,871 A * 4/1977 Hubbard ..... B43K 8/003 346/140.1
4,120,595 A * 10/1978 Moreno ..... B43K 7/005 401/35
4,306,819 A * 12/1981 Schusseler ..... B43K 8/02 401/199
D266,538 S * 10/1982 Kahn ..... D9/449
D273,395 S * 4/1984 Wilkinson ..... 401/35
4,583,982 A * 4/1986 Vlock ..... A61M 35/003 604/289
4,738,669 A * 4/1988 Vlock ..... A61M 35/003 401/256
4,826,338 A * 5/1989 Kilpatrick ..... B43K 8/003 401/35
4,850,727 A * 7/1989 Gueret ..... A45D 34/045 401/122
D302,564 S * 8/1989 Wiener ..... 401/35
5,054,504 A * 10/1991 Winrow ..... A61H 7/003 132/110
5,119,838 A * 6/1992 Nakazima ..... A45D 19/026 401/199
5,154,193 A * 10/1992 Busch ..... A45D 19/026 401/199
5,279,499 A * 1/1994 Carter ..... A46B 11/0013 401/277
5,403,357 A * 4/1995 Tsujino ..... A61K 8/39 8/405
5,592,711 A * 1/1997 Maier ..... A46B 9/02 15/166
5,638,566 A * 6/1997 Wu ..... B43K 29/18 81/177.4
5,676,480 A * 10/1997 Tosto ..... A45D 19/024 401/35
5,765,573 A * 6/1998 Gueret ..... A46B 9/02 206/823
5,996,591 A * 12/1999 Landa ..... A45D 29/00 132/74.5
6,026,824 A * 2/2000 Gueret ..... A46B 9/021 132/218
6,033,143 A * 3/2000 Gueret ..... A45D 40/28 401/129
6,250,828 B1 * 6/2001 Liu ..... B43K 8/003 401/6
6,554,517 B2 * 4/2003 Ahmed ..... B43K 27/08 401/35
6,685,373 B1 * 2/2004 Liu ..... B43K 8/003 401/35
6,817,797 B1 * 11/2004 Liu ..... B43K 27/08 401/35
6,953,296 B1 * 10/2005 Vora ..... B43K 27/08 401/35
7,001,091 B1 * 2/2006 Knight ..... B43K 8/024 401/47
D518,232 S * 3/2006 Colacioppo ..... D28/7
7,077,592 B2 * 7/2006 Gueret ..... A45D 40/267 401/128
7,255,508 B1 * 8/2007 Knight ..... C09D 11/18 401/35
7,762,270 B2 * 7/2010 De Brouwer ..... A45D 40/265 132/218
8,276,597 B1 * 10/2012 Harden ..... A45D 40/20 132/200
8,403,577 B2 3/2013 Khoshnevis
8,858,109 B2 10/2014 Kudo
9,498,045 B2 * 11/2016 Hartstock-Martin ..... A46B 11/0055
D792,217 S * 7/2017 Still ..... D28/7
10,306,969 B1 * 6/2019 Laaly ..... B43K 8/04
D873,482 S * 1/2020 Kudo ..... A45D 40/00 D28/7
D889,742 S * 7/2020 Choi ..... D28/7
D890,986 S * 7/2020 Choi ..... D28/7
11,707,125 B1 * 7/2023 Garey ..... A45D 34/04 132/112
11,779,094 B1 * 10/2023 Bickford ..... A46B 11/0062 401/117
D1,004,190 S * 11/2023 Ioan ..... D28/7
D1,068,161 S * 3/2025 Xue ..... D28/7
2002/0048482 A1 * 4/2002 Gueret ..... A45D 34/045 401/126
2002/0083953 A1 * 7/2002 Dorf ..... A46B 3/10 15/160
2003/0041869 A1 * 3/2003 Dovergne ..... A46B 9/023 132/116
2004/0001737 A1 * 1/2004 Giron ..... B43K 7/005 401/35
2004/0253034 A1 * 12/2004 Sieling ..... B43K 8/24 401/35
2005/0066989 A1 * 3/2005 Colacioppo ..... A45D 19/028 132/126
2005/0138746 A1 * 6/2005 Young-Chul ..... A46B 3/00 15/191.1
2005/0175391 A1 * 8/2005 Osborne ..... B43K 17/005 401/35
2007/0240607 A1 * 10/2007 Vincent Kwan ..... C09D 11/50 427/256
2007/0251537 A1 * 11/2007 De Laforcade ..... A45D 24/22 132/116
2007/0269258 A1 * 11/2007 Bowers ..... B43K 8/003 401/198
2008/0056802 A1 * 3/2008 Baghdoian ..... A46B 11/0079 401/35
2008/0149133 A1 * 6/2008 Fleischer ..... A45D 24/24 132/320
2008/0156339 A1 * 7/2008 Moosmann ..... A45D 24/22 401/196
2009/0154983 A1 * 6/2009 Khoshnevis ..... B43K 8/03 401/196
2009/0180825 A1 * 7/2009 Chang ..... A46B 11/0013 401/129
2009/0257811 A1 * 10/2009 Brachman ..... B43K 27/08 401/35

(56) References Cited

U.S. PATENT DOCUMENTS

2010/0224213 A1* 9/2010 Kudo ..... A45D 40/20 132/320
2011/0041863 A1* 2/2011 Roualdes ..... A45D 24/22 132/114
2011/0083690 A1* 4/2011 Cardenas ..... A46B 15/0038 15/160
2011/0168198 A1* 7/2011 Polanish ..... A46B 1/00 132/73
2012/0207533 A1* 8/2012 Liu ..... B43K 8/003 401/262
2014/0056636 A1* 2/2014 Gueret ..... A45D 34/04 401/268
2016/0135569 A1* 5/2016 Caulier ..... A45D 40/265 132/200
2016/0192768 A1* 7/2016 Johnston ..... A46B 3/12 401/287
2017/0006998 A1* 1/2017 Liu ..... B43K 8/06
2017/0251786 A1* 9/2017 Kudo ..... A45D 34/042
2017/0251787 A1* 9/2017 Kudo ..... A45D 34/042
2017/0303665 A1* 10/2017 Ashburn ..... A45D 34/04
2018/0020806 A1* 1/2018 Prade ..... A45D 40/20 401/196
2018/0055195 A1* 3/2018 Querna ..... A46B 9/021
2018/0116363 A1* 5/2018 Grez ..... A45D 24/28
2018/0140072 A1* 5/2018 Chen ..... A45D 40/20
2018/0153292 A1* 6/2018 Dovellos ..... A46B 9/025
2018/0235345 A1* 8/2018 Befve ..... A45D 34/042
2019/0298032 A1* 10/2019 Mahmood ..... A45D 40/24
2020/0015579 A1* 1/2020 Barad ..... A46B 9/021
2020/0069030 A1* 3/2020 Bae ..... B43K 27/04
2020/0138166 A1* 5/2020 Prade ..... A45D 34/041
2020/0237085 A1* 7/2020 Miller ..... A46B 13/008
2020/0269629 A1* 8/2020 Shih ..... B43K 3/00
2021/0267349 A1* 9/2021 Babic ..... A61M 37/0076
2021/0307487 A1* 10/2021 Berhault ..... A45D 40/20
2022/0061497 A1* 3/2022 Bickford ..... A45D 34/042
2023/0210241 A1* 7/2023 Lee ..... A45D 19/026 132/112
2023/0380572 A1* 11/2023 Park ..... A45D 34/042
2024/0081519 A1* 3/2024 Lu ..... A46B 9/021

FOREIGN PATENT DOCUMENTS

KR 200450582 Y1 10/2010
KR 20180001845 U 6/2018

* cited by examiner

APPLICATOR TO CREATE MULTIPLE THIN AND CLOSE LINES

SUMMARY

In one embodiment, an applicator allows drawing multiple super fine lines or dots. Previous applicators that create multiple lines cannot achieve sharp enough lines and have gaps that too wide. In one embodiment, an applicator solves the problem to create multiple lines at extreme accuracy and sharpness.

In one embodiment, the applicator will allow consumers to draw multiple fine lines or dots very close together. There can be two different uses for this type of applicator. One use of the applicator is filling the gap between lashes. This is similar to an eye liner but far more natural. The disclosed applicator creates extremely precise and sharp lines and dots because dots need to be applied at the waterline in between the eye lashes. Therefore, the dots produced are very close together to increase accuracy. A second use can be for creating microblading type effects for brows. Traditional brow microblading products have a single applicator but have issues surrounding the stability of the flow when used on brows, and the lines produced are also not so sharp.

According to one embodiment, the problem of creating fine dots and lines is solved by using a connector or other means to gather multiple fine tips closer together, such as gathering the outer tips closer to a center. In one embodiment, the connector has an angled surfaces that will bend the tips as they are inserted and the tips will eventually gather close to a point. This provides a very unique make up effect that existing applicators are not capable of. The result is very subtle yet defined lines which look very natural instead of drawn.

In one embodiment, ad tubular applicator housing has a longitudinal axis with a proximal end and a distal end with an angle connector, two or more eyeliner portions extending parallel with the longitudinal axis and passing through the angle connector to bend the eyeliner portions toward a central point.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
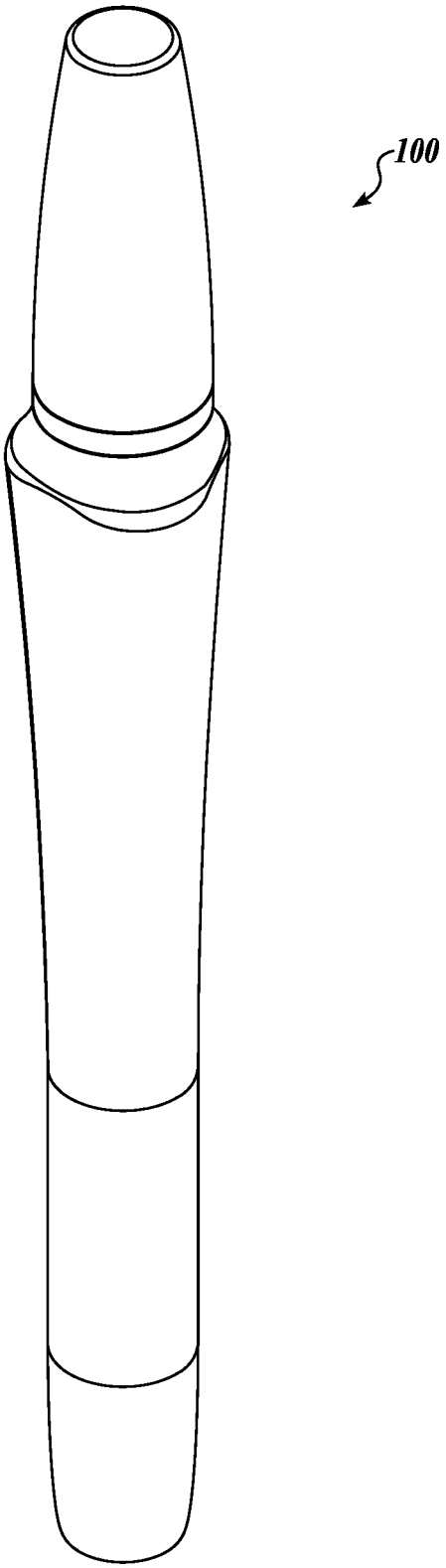
FIG. 1 is a diagrammatical illustration of an applicator in accordance with one embodiment.
Figure 2:
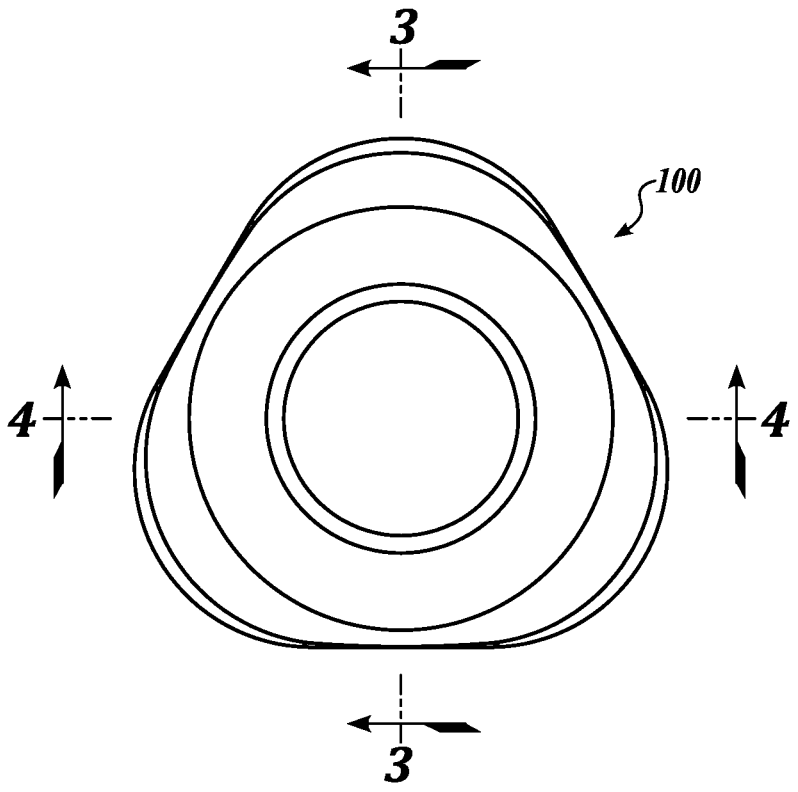
FIG. 2 is diagrammatical illustration of a top view of the applicator of FIG. 1.

FIG. 1 is a diagrammatical illustration of an applicator 100 for creating fine lines and dots, such as for applying cosmetics, but has other uses in applications where manually creating fine lines and dots is needed. The applicator 100 is described in the context of applying cosmetics, such as eye liner, but the applicator may be used for applying ink for writing instruments or paints for free-hand drafting and drawing instruments.

Figure 3:
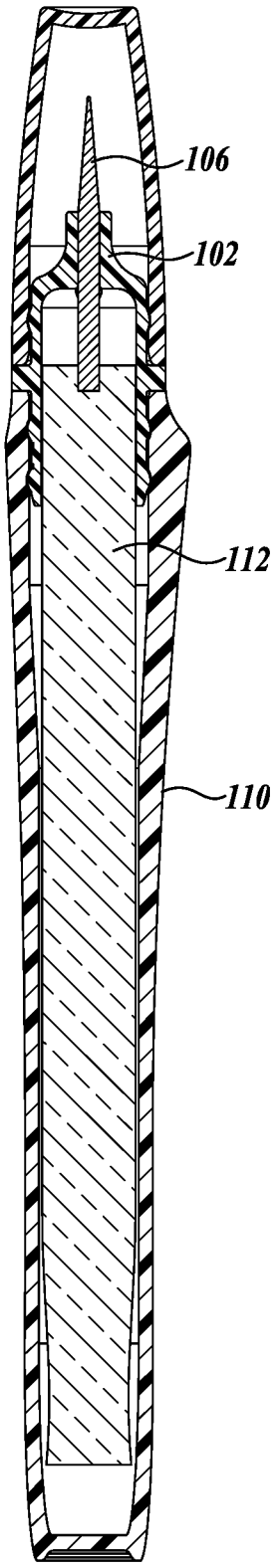
FIG. 3 is a diagrammatical illustration of a cross-sectional view of the applicator of FIG. 1.
Figure 4:
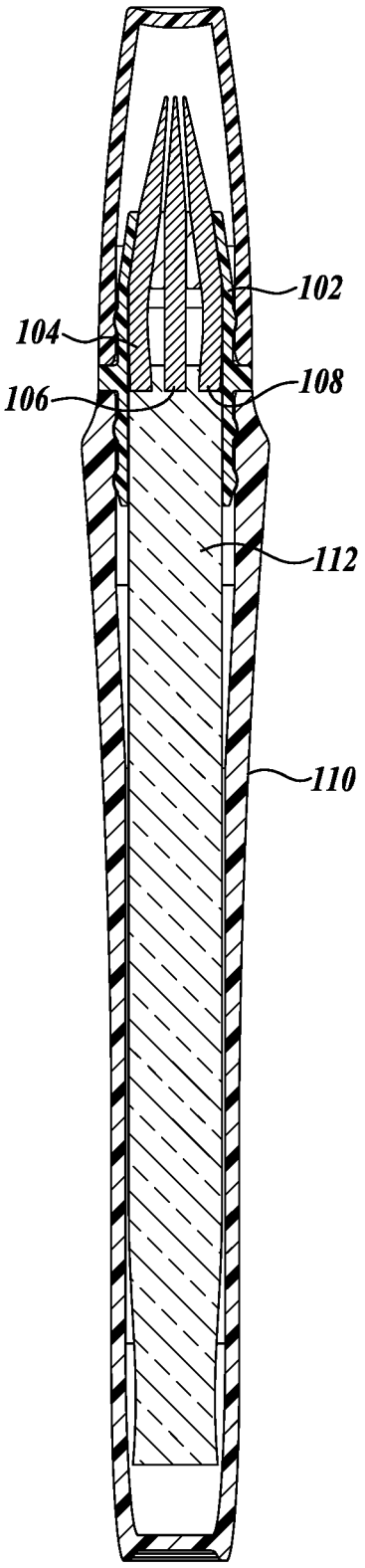
FIG. 4 is a diagrammatical illustration of a cross-sectional view of the applicator of FIG. 1.

Referring to FIGS. 3 and 4, in one embodiment, the applicator 100 includes a body sleeve 110 including an ink cartridge 112. The body sleeve 110 is capped at the top end by a drawing tool connector 102. The connector 102 in configured to hold two or more drawing tools. In the illustrated embodiment, three drawing tools 104, 106, and 108 are shown. The drawing tools 104, 106, and 108 are used for drawing fine lines or dots by applying liquid formulations, such as cosmetics, by transferring the liquid formulation from the cartridge 112 to the drawing tools 104, 106, and 108. In one embodiment, drawing tools 104, 106, and 108 carry liquid formulation through capillary action.

In one embodiment, drawing tools 104, 106, and 108 are made from material suited to transfer a liquid formulation by capillary action. In one embodiment, the drawing tools 104, 106, and 108 are made from compressed felt fibers. The felt fibers can be any natural or synthetic fibers. Similarly, the cartridge 112 can also be formed from an absorbent material, such as felt fibers. In any case, the cartridge transfer formulation to the drawing tools 104, 106, and 108. Although representative examples describe a felt drawing tool, the disclosure can be applied to other drawing tools including rolling ball pens that have a small metal tip connected to a plastic tube, a dip pen having a tip with capillary channels, flexible graphite pencils, and the like.

In one embodiment, the drawing tools 104, 106, and 108 have a flexible body The drawing tools 104, 106, 108 come to a sharp pointed tip at the distal end. In one embodiment, the tips are configured to make contact with the surface to draw the lines and dots. By bending the two drawing tools 104 and 108 at the outer sides of the connector 102 toward the center, the tips of the two drawing tools 104, 108 can be brought closer together to the tip of the center drawing tool 106. The resulting spacing between the tips is closer than what is possible by simply placing the two or more drawing tools side-by-side.

In one embodiment, the drawing tools 104, 106, and 108 can be comprised of 100% felt fibers formed into an elongated rod. In one embodiment, felt drawing tools 104, 106, and 108 can have a cross-sectional shape that is circular, square, rectangular, and the like. In one embodiment, the felt drawing tools 104, 106, and 108 begin as straight felt rods. In one embodiment, the felt drawing tools 104, 106, and 108 are shaved at the distal end to create the tips with a fine or sharp point. In one embodiment, the tips are shaped as cones having the tip at the distal end. In one embodiment, the tips are circular; however, when the cross-sectional shape of the felt rod is rectangular or square, the tips can be shaved on one or two opposite sides and the resulting tip can be a sharp edge. As will be described, one or more than one of the drawing tools 104, 106, and 108 will be caused to bend to bring the points of the tips closer together to create very fine closely spaced lines and dots.

In one embodiment, the drawing tools 104, 106, and 108 are placed within the connector 102 so that a section of the drawing tools 104, 106, 108 are within the connector 102 and the tips extend out from the connector 102. In one embodiment, the drawing tools 104, 106, and 108 are placed in physically separated holes of the connector 102 so as to be physically separated from each other.

Figure 5:
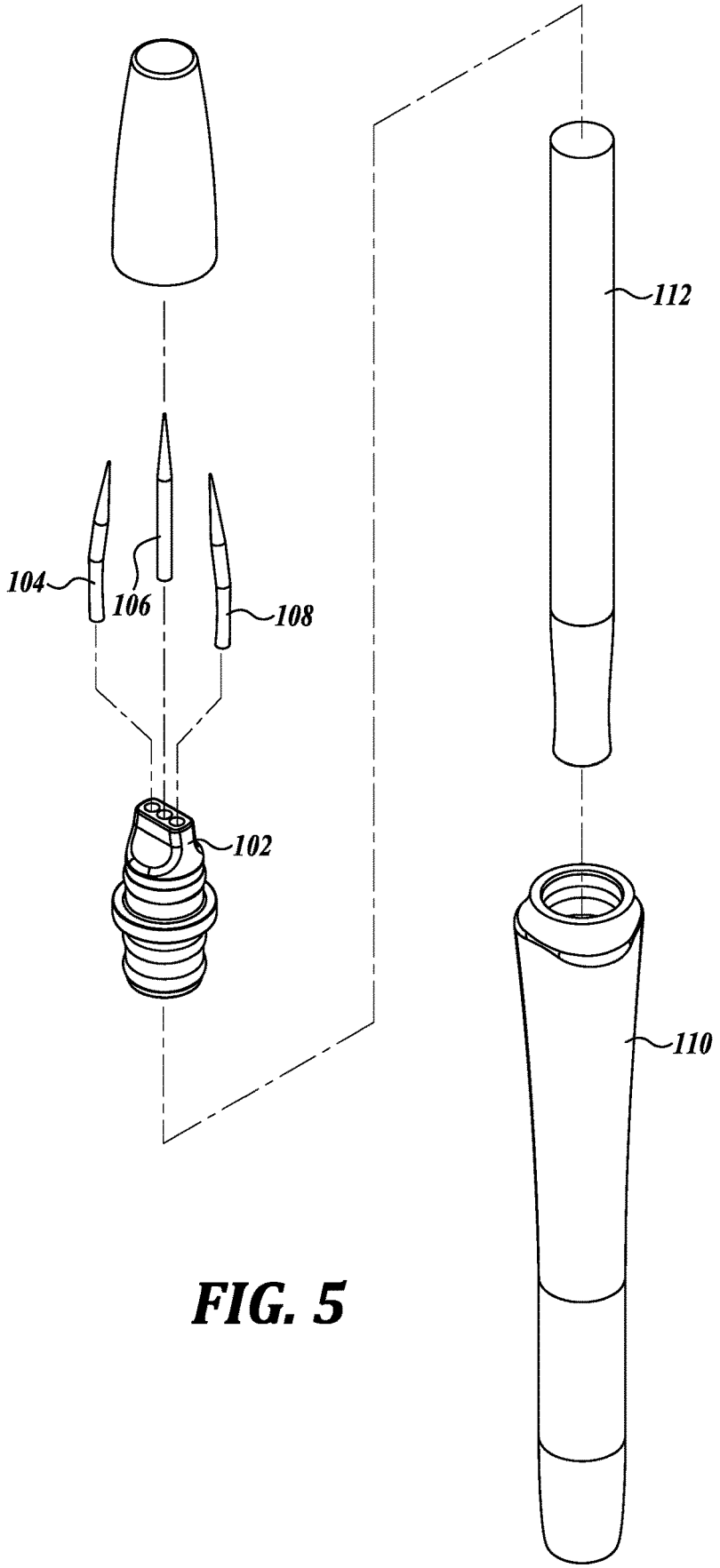
FIG. 5 is a diagrammatical illustration of an exploded view of the applicator of FIG. 1.

Referring to FIG. 5, in one embodiment, the connector 102 is generally cylindrical in shape, except at the top, where the cylindrical section tapers inwards on two opposite sides resulting in a rectangular horizontal surface on top, where the three respective holes for each of the three drawing tools are located. The holes are in a straight line which also places the tips of the drawing tools 104, 106, and 108 also in a straight line. In one embodiment, the tips of the drawing tools 104, 106, and 108 can extend out from the connector 102 to terminate at an equal height above the top surface.

Referring to FIG. 3, the drawing tool 106 is illustrated being engaged in a hole of the connector 102. It can be seen that the connector 102 provides for arranging the drawing tools 104, 106, and 108 in a straight line in one direction. However, referring to FIG. 4, the drawing tools are arranged physically separated from one another. Particularly, the connector 102 either include holes that are configured to the bend the two outer drawing tools 104, 108 toward the center to bring the tips of drawing tools 104, 108 closer to the tip of drawing tool 106, thereby, being able to create fine lines spaced very close to each other.

Referring to FIG. 4, it can be seen that the inside walls of the connector 102 juxtaposed next to the drawing tools 104 and 108 are bent inward, thereby bending the drawing tools 104 and 108 toward the center. The connector 102 may be placed on the interior or exterior of the body sleeve 110. In one embodiment, the connector 102 functions by bending one or more of the drawing tools 104, 106, and 108 to bring the tips of the drawing tools closer together. In one embodiment, the connector 102 functions to bring the tips of the two outermost drawing tools 104 and 108 closer to the tip of the central drawing tool 106. In one embodiment, the drawing tools 104 and 108 enter from the proximal side of the connector 102 at a first angle and exit the distal side of the connector 102 at a second angle different from the first angle. In one embodiment the central drawing tool 106 can pass from the proximal to distal side of the connector 102 without any bending.

In one embodiment, the connector 102 has angled interior walls that bend toward the center. Then, as the outermost drawing tools 104 and 108 pass through the connector 102, the interior angled walls of the connector 102 bend the outermost drawing tools 104 and 108 in conformance with the angled walls, thus, bringing the tips of drawing tools 104 and 108 inward closer to the central drawing tool's tip. In one embodiment, the connector 102 has a slot extending depthwise axially through the connector 102. The widthwise dimension of the slot is similar to the diameter of the drawing tools, and the lengthwise dimension of the slot is long enough to accommodate the drawing tools 104, 106, and 108 in a line with spacing between adjacent drawing tools. In the foregoing embodiment, the sides forming the ends of the lengthwise dimension of the slot would be angled inward. In one embodiment, instead of having a single slot, the connector 102 may have three holes, one hole for each drawing tool 104, 106, and 108, wherein the holes for the outermost drawing tools 104 and 108 are placed at an angle.

In one embodiment, the proximal side of the felt drawing tools 104, 106, and 108 are connected to the cartridge 112. The cartridge 112 contains a liquid formulation, and the proximal ends of the felt drawing tools 104, 106, and 108 draw up the liquid formulation. From the connection to the cartridge 112, the felt drawing tools 104, 106, and 108 extend distally. The liquid formulation then flows to the felt drawing tool tips by capillary action which replenishes the felt drawing tool tips with liquid formulation as it is used up.

In one embodiment, the cartridge 112 may be configured as a replaceable cartridge. In one embodiment, replacement cartridges can be made available in different shades of color giving the purchaser the option to choose the shade of cosmetic.

In one embodiment, the applicator 100 may include an equal number of cartridges as there are drawing tools, wherein each drawing tool is connected to a dedicated cartridge. This may be desirable, for example, if one or more of the felt drawing tools 104, 106, and 108 have a smaller diameter, and therefore, use less formulation than the other drawing tools. Furthermore, the tips of the felt drawing tools do not have to have a similar dimension. For example, each drawing tool tip can have a different size, which can create three lines or dots of different diameter, and therefore, the use of liquid formulation is not equal.

In view of the description and FIGURES, representative embodiments may include, but are not limited to the following.

In one embodiment, an applicator that draws fine lines and dots, comprises a body sleeve having a shape of an elongated tube; a first drawing tool having a first section within the body sleeve and a first tip extending out from the body sleeve, wherein the first drawing tool reduces in size at a distal end of the first drawing tool; a second drawing tool having a second section within the body sleeve and a second tip extending out from the body sleeve, wherein the second drawing tool reduces in size at a distal end of the second drawing tool; and the first drawing tool, the second drawing tool, or both first and second drawing tools have a bend to bring the first and second tips closer together.

In one embodiment, the applicator further comprises a third drawing tool having a third section within the body sleeve and a third tip extending out from the body sleeve, wherein the third drawing tool reduces in size at a distal end of the third drawing tool, wherein the third drawing tool is between the first and second drawing tools, and the third drawing tool does not have a bend.

In one embodiment, the first, second, and third tips are in a line.

In one embodiment, any two adjacent tips are physically separated from each other by a space not greater than 4 mm or by a space not greater than 2 mm.

In one embodiment, the first drawing tool has a bend to bring the first tip closer to the third tip, and the second drawing tool has a bend to bring the second tip closer to the third tip.

In one embodiment, the first, second, and third tips extend out from the body sleeve about an equal height.

In one embodiment, the first, second, and third drawing tools carry a formulation from the body sleeve to the first, second, and third tips by capillary action.

In one embodiment, the formulation is a cosmetic formulation.

In one embodiment, the first, second, and third drawing tools have a rod-shaped section extending into the body sleeve and a cone-shaped section for the tip.

In one embodiment, the applicator further comprises a connector on the body sleeve having a first angled interior wall that bends the first drawing tool and a second angled interior wall that bends the second drawing tool.

In one embodiment, the first drawing tool and the second drawing tool are flexible to allow bending along the length.

In one embodiment, a method for making an applicator that draws fine lines or dots, comprises adding a bend in one or more drawing tools to bring drawing tool tips closer together.

In one embodiment, the method further comprises assembling more than one drawing tools within a body sleeve, wherein a section of each of the more than one drawing tools is within the body sleeve and each tip extends outside the body sleeve, wherein the more than one drawing tools comprise a material that carries a formulation to the tips.

In one embodiment, the method further comprises adding a connector to the body sleeve that bends the one or more drawing tools.

In one embodiment, the connector includes an angled interior wall that bends the one or more drawing tools.

In one embodiment, the bent drawing tools enter the connector on a proximal side of the connector at a first angle and exit a distal side of the connector at a second angle different than the first angle.

In one embodiment, a method of applying a cosmetic formulation comprises drawing fine lines or dots between or in proximity to eyelashes or eyebrow hairs with any embodiments of the applicator.

While illustrative embodiments have been illustrated and described, it will be appreciated that various changes can be made therein without departing from the spirit and scope of the invention.

The embodiments of the invention in which an exclusive property or privilege is claimed are defined as follows:

1. An applicator that draws fine lines and dots, comprising:

a body sleeve having a shape of an elongated tube;

an ink cartridge within the body sleeve;

a connector having a radial section placed on an end of the body sleeve, a section below the radial section configured to fit on a distal end of the ink cartridge, and first and second apertures extending through the connector, each of the first and second apertures including a portion that is angled radially inward;

a first drawing tool having a first section within the body sleeve and a first tip extending out from the body sleeve, wherein the first drawing tool reduces in size at a distal end of the first drawing tool and a proximal end of the first drawing tool contacts the ink cartridge, the first drawing tool is made from an absorbent material; and a second drawing tool having a second section within the body sleeve and a second tip extending out from the body sleeve, wherein the second drawing tool reduces in size at a distal end of the second drawing tool and a proximal end of the second drawing tool contacts the ink cartridge, the second drawing tool is made from the absorbent material;

wherein the first drawing tool extends through the first aperture, the portion of the first aperture that is angled radially inward directing the first tip toward the second tip, the second drawing tool extending through the second aperture, the portion of the second aperture that is angled radially inward directing the second tip toward the first tip, wherein the first drawing tool and the second drawing tool are flexible to allow bending along the length of the first and the second drawing tools, wherein the bend in the first and second drawing tools is located between the distal and proximal ends of the first and second drawing tools;

wherein the first drawing tool and the second drawing tool are separated along a lengthwise dimension, wherein a distance between the first drawing tool and the second drawing tool proximally before the bend is greater than a distance between the first drawing tool and the second drawing tool distally after the bend, the tips being arranged non-parallel to each other.

2. The applicator of claim 1, further comprising:

a third aperture extending through a central portion of the connector between the first and second apertures; and a third drawing tool having a third section within the body sleeve and a third tip extending out from the body sleeve, wherein the third drawing tool reduces in size at a distal end of the third drawing tool and a proximal end of the third drawing tool contacts the ink cartridge, the third drawing tool is made from the absorbent material, wherein the third drawing tool is between the first and second drawing tools, and the third drawing tool does not have a bend.

3. The applicator of claim 2, wherein the first, second, and third tips are in a line.

4. The applicator of claim 2, wherein any two adjacent tips are physically separated from each other by a space not greater than 4 mm or by a space not greater than 2 mm.

5. The applicator of claim 2, wherein the first drawing tool has a bend to bring the first tip closer to the third tip, and the second drawing tool has a bend to bring the second tip closer to the third tip.

6. The applicator of claim 2, wherein the first, second, and third tips extend out from the body sleeve to an equal height.

7. The applicator of claim 2, wherein the first, second, and third drawing tools carry a formulation from the ink cartridge to the first, second, and third tips by capillary action.

8. The applicator of claim 7, wherein the formulation is a cosmetic formulation.

9. The applicator of claim 2, wherein the first, second, and third drawing tools have a rod-shaped section extending into the body sleeve and a cone-shaped section for the tip.

10. The applicator of claim 2, wherein the first, second, and third drawing tools are aligned in a radial direction.

11. A method for making an applicator that draws fine lines or dots, comprising:

placing a first drawing tool having a first section within a body sleeve with a first tip extending out from the body sleeve, wherein the first drawing tool reduces in size at a distal end of the first drawing tool and a proximal end of the first drawing tool contacts an ink cartridge, the first drawing tool is made from an absorbent material;

placing a second drawing tool having a second section within the body sleeve and a second tip extending out from the body sleeve, wherein the second drawing tool reduces in size at a distal end of the second drawing tool and a proximal end of the second drawing tool contacts the ink cartridge, the second drawing tool is made from the absorbent material;

adding a connector at an end of the body sleeve, the connector having a radial section configured to be placed on the end of the body sleeve, a section below the radial section configured to fit on a distal end of the ink cartridge, first and second apertures extending through the connector, each of the first and second apertures including a portion that is angled radially inward, the first and second apertures receiving the first and second drawing tools, respectively, therethrough, the radially inward angled portions of the first and second apertures guiding the first and second tips toward each other, wherein the first drawing tool and the second drawing tool are separated along a lengthwise dimension, wherein a distance between the first drawing tool and the second drawing tool proximally before the bend is greater than a distance between the first drawing tool and the second drawing tool distally after the bend, the tips being arranged non-parallel to each other.

12. The method of claim 11, wherein the bent drawing tools enter the connector on a proximal side of the connector at a first angle and exit a distal side of the connector at a second angle different than the first angle.

13. A method of applying a cosmetic formulation, comprising:

drawing fine lines or dots between or in proximity to eyelashes or eyebrow hairs with the applicator of claim 1.

* * * * *